US008028679B2

(12) United States Patent
Willi et al.

(10) Patent No.: US 8,028,679 B2
(45) Date of Patent: Oct. 4, 2011

(54) ENGINE CONTROL SYSTEM HAVING PRESSURE-BASED TIMING

(75) Inventors: Martin L. Willi, Dunlap, IL (US); Scott B. Fiveland, Metamora, IL (US); David T. Montgomery, Edelstein, IL (US); Weidong Gong, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 197 days.

(21) Appl. No.: 12/292,832

(22) Filed: Nov. 26, 2008

(65) Prior Publication Data

US 2010/0126465 A1 May 27, 2010

(51) Int. Cl.
*F02M 1/00* (2006.01)

(52) U.S. Cl. ..... 123/437; 123/435; 123/90.15; 123/348

(58) Field of Classification Search ..... 123/435, 123/90.15, 90.11, 90.12, 399, 403, 404, 321, 123/322, 345–348, 437, 438
See application file for complete search history.

(56) References Cited

U.S. PATENT DOCUMENTS 4,604,701 A * 8/1986 Fujawa et al. ..... 701/99
5,027,769 A 7/1991 Yoshida et al.
5,168,954 A 12/1992 Nakaniwa et al.
5,325,829 A 7/1994 Iwasiuk
5,765,532 A 6/1998 Loye
5,806,490 A 9/1998 Nogi et al.
5,878,717 A 3/1999 Zur Loye
6,000,384 A 12/1999 Brown et al.
6,199,540 B1 * 3/2001 Katashiba et al. ..... 123/478
6,276,334 B1 8/2001 Flynn et al.
6,286,482 B1 9/2001 Flynn et al.
6,354,268 B1 3/2002 Beck et al.
6,371,092 B1 4/2002 Guglielmo et al.
6,397,814 B1 6/2002 Nagaishi et al.
6,481,269 B2 * 11/2002 Maruta et al. ..... 73/114.63
(Continued)

FOREIGN PATENT DOCUMENTS

EP 0 945 606 A2 9/1999
(Continued)

OTHER PUBLICATIONS

"Throttleless engines—BMW Valvetronic" posted at http://www.autozine.org/technical_school/petrol2.htm (available Feb. 15, 2005).

(Continued)

*Primary Examiner* — John T Kwon
(74) *Attorney, Agent, or Firm* — Finnegan, Henderson, Farabow, Garrett & Dunner LLP

(57) ABSTRACT

A control system for an engine having a first cylinder and a second cylinder is disclosed having a first engine valve movable to regulate a fluid flow of the first cylinder and a first actuator associated with the first engine valve. The control system also has a second engine valve movable to regulate a fluid flow of the second cylinder and a sensor configured to generate a signal indicative of a pressure within the first cylinder. The control system also has a controller that is in communication with the first actuator and the sensor. The controller is configured to compare the pressure within the first cylinder with a desired pressure and selectively regulate the first actuator to adjust a timing of the first engine valve independently of the timing of the second engine valve based on the comparison.

17 Claims, 3 Drawing Sheets

U.S. PATENT DOCUMENTS

| | | | | |
|---|---|---|---|---|
| 6,651,618 | B1 | 11/2003 | Coleman et al. | |
| 6,681,729 | B2 * | 1/2004 | Gaessler et al. | 123/90.11 |
| 6,732,685 | B2 | 5/2004 | Leman | |
| 6,799,552 | B2 | 10/2004 | Crowell et al. | |
| 6,843,231 | B1 | 1/2005 | Duffy et al. | |
| 6,882,929 | B2 | 4/2005 | Liang et al. | |
| 6,935,287 | B2 | 8/2005 | Shinogle | |
| 6,941,909 | B2 | 9/2005 | Robel et al. | |
| 6,976,459 | B2 * | 12/2005 | Kagy et al. | 123/90.15 |
| 6,986,330 | B2 | 1/2006 | Fuwa et al. | |
| 7,000,596 | B2 | 2/2006 | Zurloye et al. | |
| 7,055,492 | B2 | 6/2006 | Yamaoka et al. | |
| 7,066,142 | B2 | 6/2006 | Hanasato | |
| 7,073,485 | B2 | 7/2006 | Truscott et al. | |
| 7,080,615 | B2 | 7/2006 | Shinogle | |
| 7,113,861 | B2 * | 9/2006 | Jacobson | 701/101 |
| 7,131,416 | B2 | 11/2006 | Sasaki et al. | |
| 7,152,559 | B2 | 12/2006 | Kuo et al. | |
| 7,156,070 | B2 | 1/2007 | Strom et al. | |
| 7,178,491 | B2 | 2/2007 | Chang | |
| 7,201,121 | B2 | 4/2007 | Weber et al. | |
| 7,204,212 | B2 * | 4/2007 | Donaldson | 123/90.12 |
| 7,210,457 | B2 | 5/2007 | Kuzuyama | |
| 7,213,553 | B2 | 5/2007 | Kalish et al. | |
| 7,228,828 | B2 | 6/2007 | Kagy et al. | |
| 7,295,912 | B2 | 11/2007 | Yasui et al. | |
| 7,325,529 | B2 | 2/2008 | Ancimer et al. | |
| 7,331,317 | B2 | 2/2008 | Yasui et al. | |
| 7,347,171 | B2 | 3/2008 | Leman et al. | |
| 7,367,318 | B2 | 5/2008 | Moriya et al. | |
| 7,400,966 | B2 | 7/2008 | Strom et al. | |
| 7,594,493 | B2 * | 9/2009 | Matekunas et al. | 123/299 |
| 2002/0195086 | A1 | 12/2002 | Beck et al. | |
| 2004/0244742 | A1 | 12/2004 | Chang | |
| 2005/0039723 | A1 | 2/2005 | Miura | |
| 2005/0140208 | A1 | 6/2005 | Ji | |
| 2005/0193980 | A1 | 9/2005 | Doering | |
| 2005/0241597 | A1 | 11/2005 | Weber et al. | |
| 2005/0241613 | A1 | 11/2005 | Weber et al. | |
| 2005/0247286 | A1 | 11/2005 | Weber et al. | |
| 2007/0062193 | A1 | 3/2007 | Weber et al. | |
| 2007/0089697 | A1 | 4/2007 | Hara et al. | |
| 2008/0035111 | A1 | 2/2008 | Schmid et al. | |
| 2010/0126463 | A1 | 5/2010 | Willi et al. | |
| 2010/0131172 | A1 | 5/2010 | Willi et al. | |

FOREIGN PATENT DOCUMENTS

| | | | |
|---|---|---|---|
| EP | 1 772 608 | A1 | 4/2007 |
| JP | 03011126 | A | 1/1991 |
| JP | 03151518 | A | 6/1991 |
| JP | 06108884 | A | 4/1994 |
| JP | 09250379 | A | 9/1997 |
| JP | 2002285913 | A | 10/2002 |
| JP | 2006188952 | A | 7/2006 |

OTHER PUBLICATIONS

"2008 Volkswagen Touareg BlueTDI" posted at http://www.supercarnews.net/2008-volkswagen-tuareg-blue-tdi (available Jul. 4, 2007).

* cited by examiner

ENGINE CONTROL SYSTEM HAVING PRESSURE-BASED TIMING

STATEMENT OF GOVERNMENT INTEREST

This invention was made with Government support under Contract No. DE-FC02-01CH11079, awarded by the Department of Energy. The Government may have certain rights in this invention.

TECHNICAL FIELD

The present disclosure is directed to an engine control system and, more particularly, to an engine control system having pressure-based timing.

BACKGROUND

Combustion engines are often used for power generation applications. These engines can be gaseous-fuel driven and implement lean burn, during which air/fuel ratios are higher than in conventional engines. For example, these gas engines can admit about 75% more air than is theoretically needed for stoichiometric combustion. Lean-burn engines increase fuel efficiency because they utilize homogeneous mixing to burn less fuel than a conventional engine and produce the same power output.

Though using lean burn may increase efficiency, gaseous fuel-powered engines may be limited by variations in combustion pressures between cylinders of the engine. Gaseous fuel-powered engines are typically pre-mix charge engines, where fuel and air are mixed within an intake manifold and then admitted to a combustion chamber of the engine. Variations in combustion pressure result from more air/fuel mixture being admitted into some cylinders than into other cylinders. This uneven distribution of the air/fuel mixture can result in pockets of the air/fuel mixture burning outside of the envelope of normal combustion, increasing the tendency for an engine to knock. The combustion pressure variations can result in cylinder pressures that are significantly higher than average peak cylinder pressures normally seen within the engine. And, because significantly higher cylinder pressures can cause the engine to operate improperly, a margin of error is required to accommodate the pressure variations. As a result, the engine may be required to operate at a level far enough below its load limit to compensate for the pressure variation between the cylinders, thereby lowering the load rating of the engine. Additionally, the pressure variations can cause fluctuation in engine torque and speed, which may be undesirable for some electrical power generation applications.

An exemplary natural gas engine system is described in U.S. Pat. No. 7,210,457 B2 (the '457 patent), issued to Kuzuyama on May 1, 2007. The '457 patent discloses an engine having a plurality of cylinders that are associated with a variable valve timing device. The '457 patent also discloses a control apparatus and a sensor that detects information related to the combustion state within the cylinders. Based on information provided by the sensor, the control apparatus identifies the one cylinder having the most violent combustion. The control apparatus then controls the variable valve timing device to adjust a valve timing of all of the cylinders based on the identification. The control apparatus also adjusts a fuel injection amount to all of the cylinders based on the identification. The control apparatus thereby suppresses the combustion of all of the cylinders such that the combustion state of the most violent cylinder becomes an appropriate combustion state.

Although the engine system of the '457 patent may limit excessive pressures in any one cylinder by suppressing combustion in all of the cylinders, the benefit thereof may be limited. That is, because the controller of the '457 patent simultaneously reduces the combustion of all of the cylinders by the same amount, the controller of the '457 patent may fail to properly balance the loading between the cylinders. A load imbalance may result in fluctuations in engine torque and speed that can negatively affect electrical power generation. Further, the controller of the '457 patent may needlessly reduce output of all cylinders, where reduction of only one cylinder is required, thereby lowering an overall rating of the engine.

The present disclosure is directed to overcoming one or more of the shortcomings set forth above and/or other deficiencies in existing technology.

SUMMARY OF THE DISCLOSURE

In accordance with one aspect, the present disclosure is directed toward a control system for an engine having a first cylinder and a second cylinder. The control system includes a first engine valve movable to regulate a fluid flow of the first cylinder, a first actuator associated with the first engine valve, and a second engine valve movable to regulate a fluid flow of the second cylinder. The control system further includes a sensor configured to generate a signal indicative of a pressure within the first cylinder, and a controller in communication with the first actuator and the sensor. The controller is configured to compare the pressure within the first cylinder with a desired pressure, and to selectively regulate the first actuator to adjust a timing of the first engine valve independently of a timing of the second engine valve based on the comparison.

According to another aspect, the present disclosure is directed toward a method of operating an engine. The method includes sensing a parameter indicative of a pressure within a cylinder of the engine, and comparing the pressure to a desired pressure. The method also includes adjusting a valve timing associated with the cylinder independently of valve timings associated with other cylinders of the engine based on the comparison.

DETAILED DESCRIPTION

Figure 1:
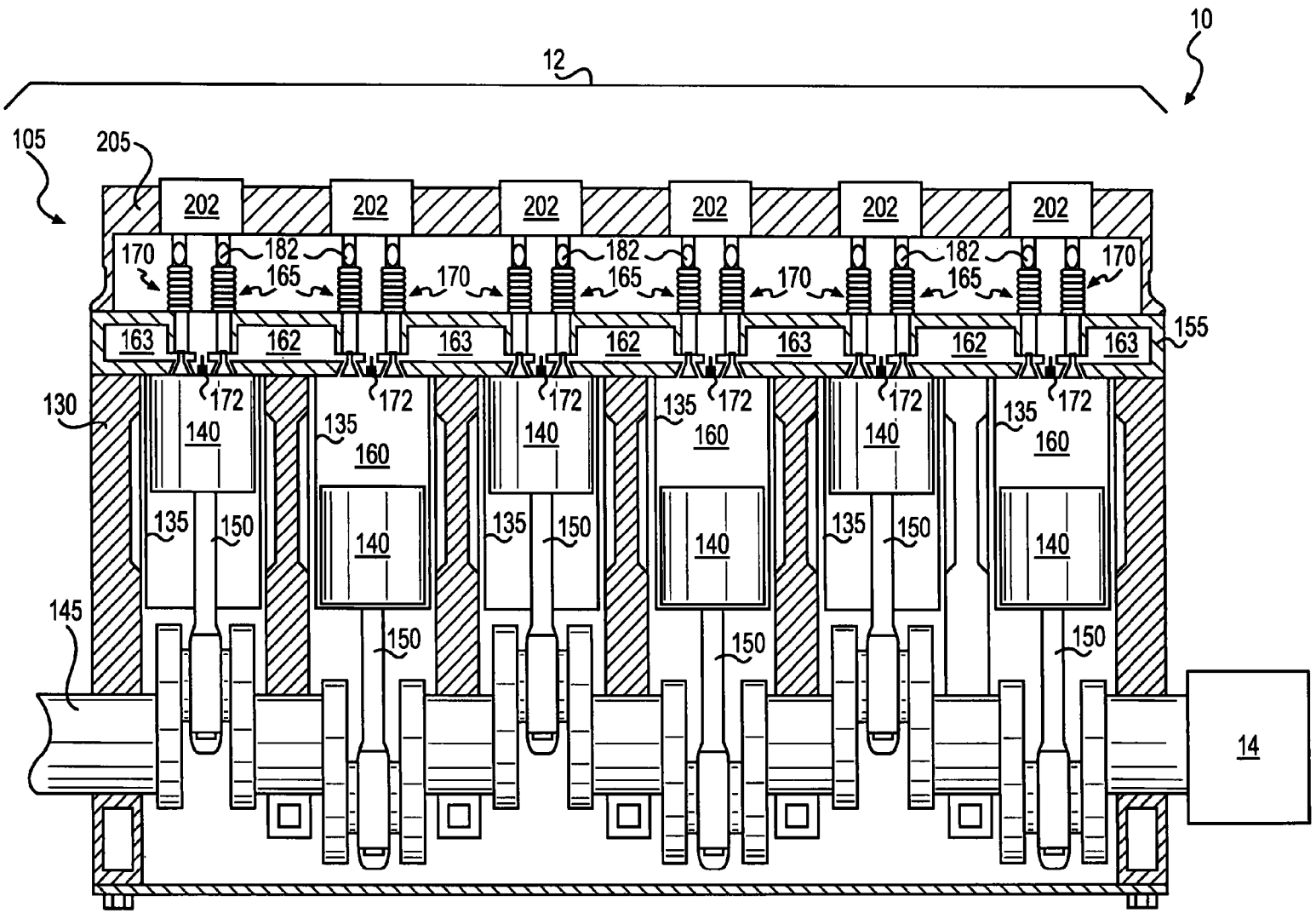
FIG. 1 is a pictorial illustration of an exemplary disclosed generator set.

FIG. 1 illustrates a generator set (genset) 10 having a prime mover 12 coupled to mechanically rotate a generator 14 that provides electrical power to an external load (not shown). Generator 14 may be, for example, an AC induction generator, a permanent-magnet generator, an AC synchronous generator, or a switched-reluctance generator. In one embodiment, generator 14 may include multiple pairings of poles (not shown), each pairing having three phases arranged on a circumference of a stator (not shown) to produce an alternating current with a frequency of about 50 and/or 60 Hz. Electrical power produced by generator 14 may be directed for offboard purposes to the external load.

Figure 2:
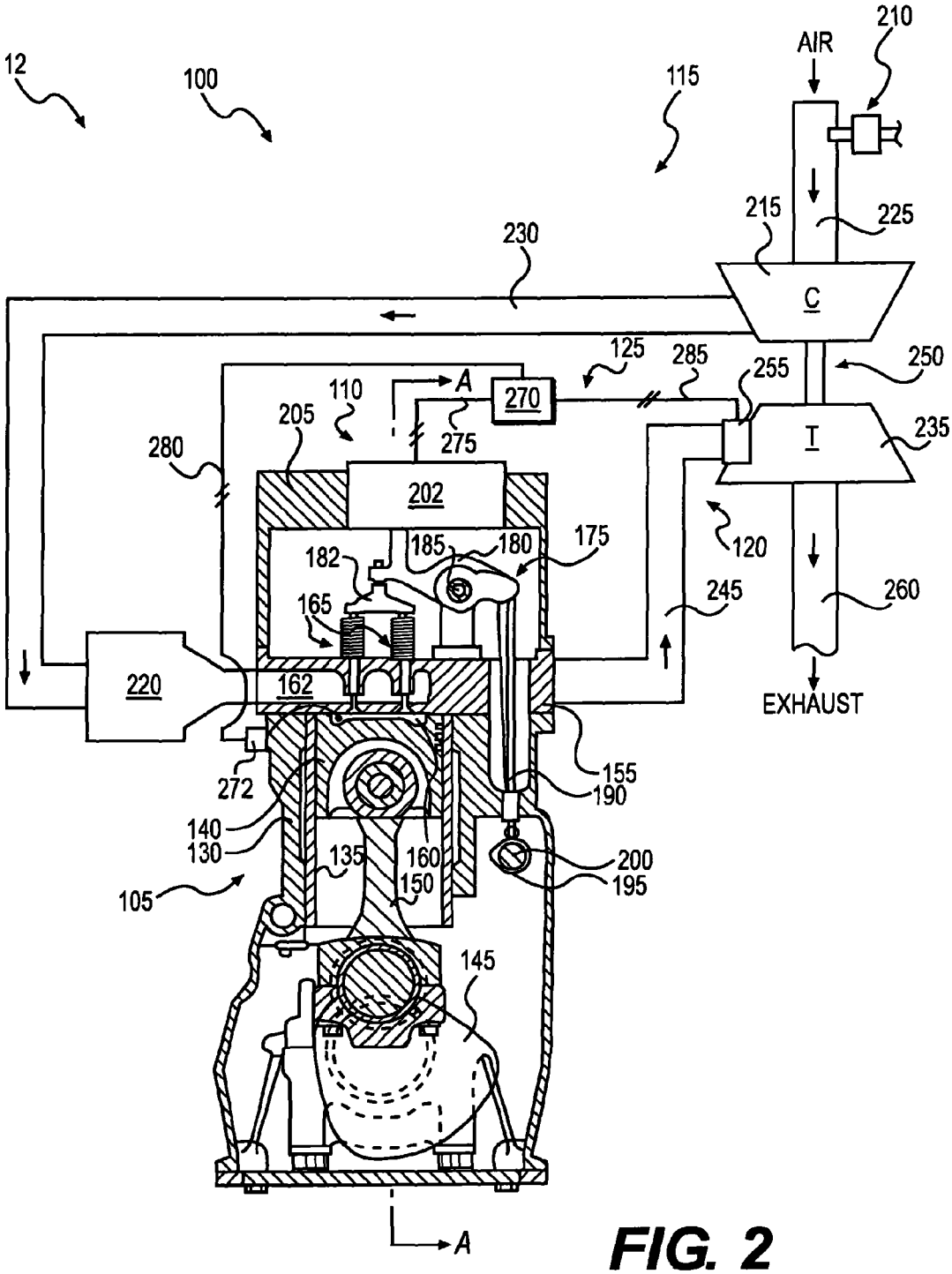
FIG. 2 is a schematic illustration of an exemplary disclosed engine system associated with the generator set of FIG. 1.

Prime mover 12 may include an engine system 100, as illustrated in FIG. 2. Engine system 100 may include an engine 105, a variable valve actuation system 110, an intake system 115, an exhaust system 120, and a control system 125. Intake system 115 may deliver air and/or fuel to engine 105, while exhaust system 120 may direct combustion gases from engine 105 to the atmosphere. Variable valve actuation system 110 may vary a valve timing of engine 105 to affect fluid flow of engine 105. Control system 125 may control an operation of variable valve actuation system 110, intake system 115, and/or exhaust system 120.

Engine 105 may be a four-stroke diesel, gasoline, or gaseous fuel-powered engine. As such, engine 105 may include an engine block 130 at least partially defining a plurality of cylinders 135 (only one shown in FIG. 2). In the illustrated embodiment of FIG. 1, engine 105 is shown to include six cylinders 135. However, it is contemplated that engine 105 may include a greater or lesser number of cylinders 135 and that cylinders 135 may be disposed in an "in-line" configuration, a "V" configuration, or in any other suitable configuration.

A piston 140 may be slidably disposed within each cylinder 135, so as to reciprocate between a top-dead-center (TDC) position and a bottom-dead-center (BDC) position during an intake stroke, a compression stroke, a combustion or power stroke, and an exhaust stroke. Returning to FIG. 2, pistons 140 may be operatively connected to a crankshaft 145 via a plurality of connecting rods 150. Crankshaft 145 may be rotatably disposed within engine block 130, and connecting rods 150 may connect each piston 140 to crankshaft 145 so that a reciprocating motion of each piston 140 results in a rotation of crankshaft 145. Similarly, a rotation of crankshaft 145 may result in a sliding motion of each piston 140 between the TDC and BDC positions. As shown in the lower portion of the graph of FIG. 3, piston 140 may move through the intake stroke from the TDC position (crank angle of about 0 degrees) to the BDC position (crank angle of about 180 degrees) to draw air and/or fuel into the respective cylinder 135. Piston 140 may then return to the TDC position (crank angle of about 360 degrees), thereby compressing the air/fuel mixture during the compression stroke. The compressed air/fuel mixture may ignite, causing piston 140 to move back to the BDC position (crank angle of about 540 degrees) during the power stroke. Piston 140 may then return to the TDC position (crank angle of about 720 degrees) to push exhaust gas from cylinder 135 during the exhaust stroke.

One or more cylinder heads 155 may be connected to engine block 130 to form a plurality of combustion chambers 160. As shown in FIG. 1, cylinder head 155 may include a plurality of intake passages 162 and exhaust passages 163 integrally formed therein. One or more intake valves 165 may be associated with each cylinder 135 and movable to selectively block flow between intake passages 162 and combustion chambers 160. One or more exhaust valves 170 may also be associated with each cylinder 135 and movable to selectively block flow between combustion chambers 160 and exhaust passages 163. Additional engine components may be disposed in cylinder head 155 such as, for example, a plurality of sparkplugs 172 that ignite an air/fuel mixture in combustion chambers 160.

Combustion pressures may vary between different cylinders 135 and between different combustion cycles of a single cylinder 135 during engine operation. Combustion pressures may vary between cylinders 135, for example, because of an uneven distribution of air/fuel mixture delivered to the plurality of cylinders 135 via intake valve 165. Combustion pressures may vary between combustion cycles of the same cylinder 135, for example, because varying amounts of the delivered air/fuel mixture may be combusted in a given combustion cycle, thereby leaving some air/fuel mixture behind within cylinder 135. This residual air/fuel mixture may affect the combustion pressure of a subsequent combustion cycle.

Engine 105 may include a plurality of valve actuation assemblies 175 that affect movement of intake valves 165 and/or exhaust valves 170 to help minimize engine knock. Each cylinder 135 may have an associated valve actuation assembly 175. Referring back to FIG. 2, each valve actuation assembly 175 may include a rocker arm 180 connected to move a pair of intake valves 165 via a bridge 182. Rocker arm 180 may be mounted to cylinder head 155 at a pivot point 185, and connected to a rotating camshaft 200 by way of a push rod 190. Camshaft 200 may be operatively driven by crankshaft 145, and may include a plurality of cams 195 that engage and move push rods 190.

Figure 3:
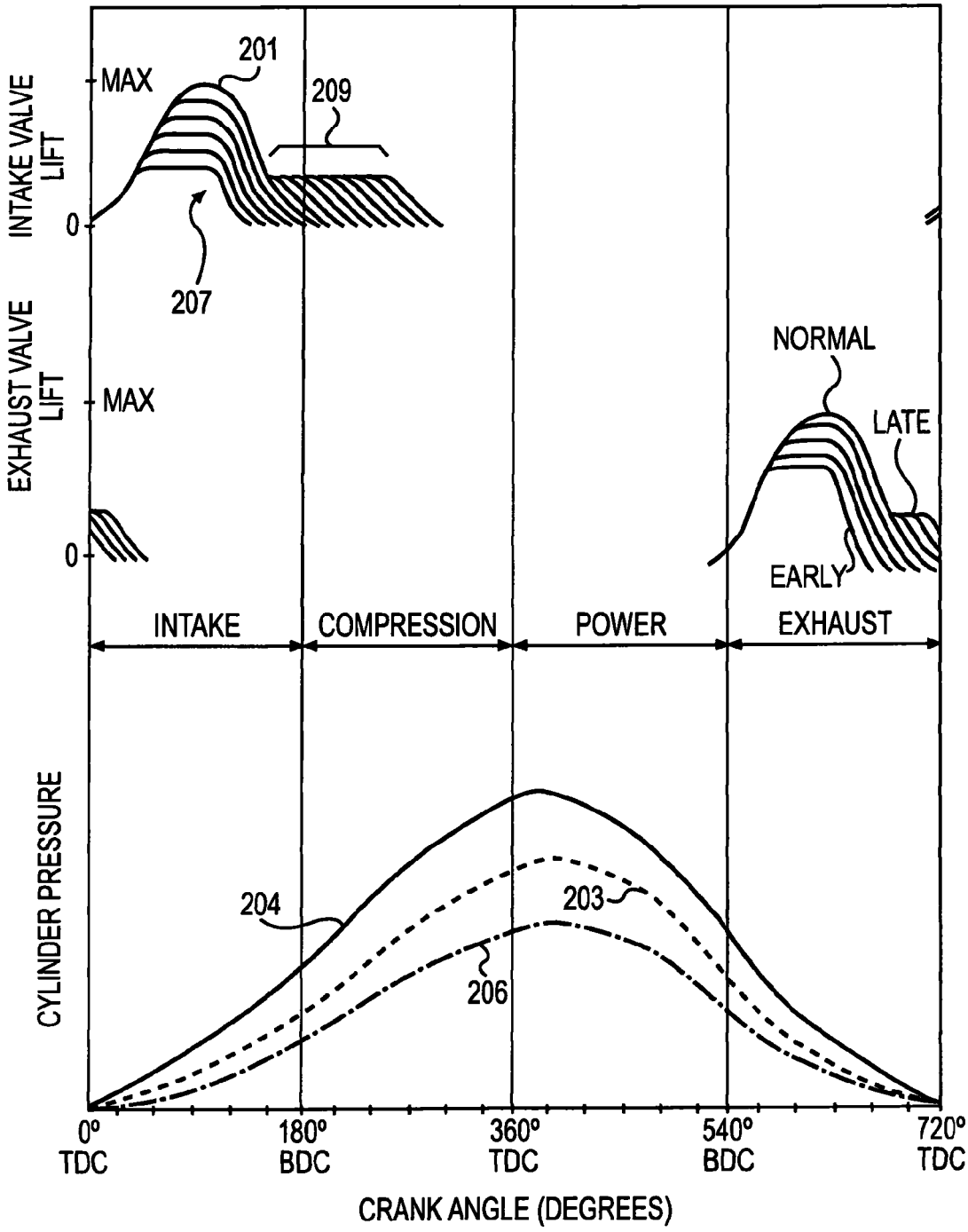
FIG. 3 is an exemplary disclosed graph associated with operation of the engine system of FIG. 2.

As pistons 140 move through the four stokes of the combustion cycle (i.e., intake, compression, power, and exhaust), crankshaft 145 may cyclically drive each valve actuation assembly 175 to move intake valves 165 and/or exhaust valves 170. As shown in FIG. 3, valve actuation assembly 175 may cause intake valve 165 to open during the intake stroke of piston 140. Actuation of intake valves 165 may generally follow profile 201 shown in the upper portion of the graph of FIG. 3. Intake valve 165 may open during the intake stroke, for example, at a crank angle of about 690° to about 0°, and may close at a crank angle of about 210°. Intake valve 165 may displace from a closed position to a maximum open position, during which the air/fuel mixture may be admitted into combustion chamber 160.

A pressure profile of cylinder 135 may substantially match a desired profile 203 during typical combustion events, as shown in the lower portion of the graph of FIG. 3. During a typical combustion event, a pressure within cylinder 135 may reach a peak at a crank angle of between about 360° to about 375° (i.e., at the end of the compression and beginning of the power strokes). Also, during the compression stroke of a typical combustion event, a rate of the pressure rise within cylinder 135 (i.e., a rise-rate of the pressure) may substantially match the slope of desired profile 203.

An undesired profile 204, shown in FIG. 3, illustrates a combustion state in which the pressure rise-rate and/or the pressure magnitude is greater than desired. In this case, the peak cylinder pressure may reach a higher magnitude than desired (i.e., greater than profile 203). Another undesired profile 206, shown in FIG. 3, illustrates a combustion state in which the pressure rise-rate and/or the pressure magnitude is lower than desired. In this case, the peak cylinder pressure may have a lower magnitude than desired (i.e., lower than profile 203). Profiles 203, 204, and 206 are illustrative only, and may vary based on engine operation such as, for example, based on valve timing.

Varying a closing of intake valve 165 may change the pressure profile within cylinder 135 (i.e., a rise-rate and/or a magnitude of the pressure). As shown by a family of curves 207 in FIG. 3, a closing of intake valve 165 may be selectively varied during the intake and/or the compression strokes by any appropriate amount. When intake valve 165 is closed within the family of curves 207, intake valve 165 may be selectively advanced and/or retarded. When intake valve 165 is advanced within the family of curves 207 (i.e., the closing is adjusted to be further away from profile 201), less air/fuel mixture may be trapped within cylinder 135, resulting in a decrease in pressure rise-rate and/or pressure magnitude within cylinder 135. When intake valve 165 is retarded within the family of curves 207 (i.e., the closing is adjusted toward profile 201), more air/fuel mixture may be trapped within cylinder 135, resulting in an increase in pressure rise-rate and/or pressure magnitude within cylinder 135. Intake valve 165 may also be selectively varied during the intake and/or the compression strokes by any appropriate amount within a family of curves 209, shown in FIG. 3. When intake valve 165 is closed within the family of curves 209, the closing may be selectively advanced and/or retarded. When intake valve 165 is retarded within the family of curves 209 (i.e., the closing is adjusted to be further away from profile 201), less air/fuel mixture may be trapped within cylinder 135, resulting in a decrease in pressure rise-rate and/or pressure magnitude within cylinder 135. When intake valve 165 is advanced within the family of curves 209 (i.e., the closing is adjusted toward profile 201), more air/fuel mixture may be trapped within cylinder 135, resulting in an increase in pressure rise-rate and/or pressure magnitude within cylinder 135. Intake valve 165 may be varied by an amount that substantially correlates to a comparison of an actual or anticipated pressure profile with the desired profile 203. Intake valve 165 may be varied by a greater or lesser amount, as required, to regulate the fluid flow to cylinder 135 and thereby bring the combustion profile within cylinder 135 toward the desired profile 203.

For example, when profile 204 is detected within cylinder 135, the closing of intake valve 165 may be advanced within the family of curves 207 or retarded within the family of curves 209 to decrease the magnitude and pressure rise-rate within cylinder 135 toward desired profile 203. The closing of intake valve 165 may thereby be adjusted away from a profile of intake valve 165 having a timing that has not been varied (i.e., away from unadjusted profile 201) when the pressure within cylinder 135 is higher than a desired pressure. In contrast, when profile 206 is detected within cylinder 135, the closing of intake valve 165 may be retarded within the family of curves 207 or advanced within the family of curves 209 to increase the magnitude and pressure rise-rate within cylinder 135 toward desired profile 203. The closing of intake valve 165 may thereby be adjusted toward a profile of intake valve 165 having a timing that has not been varied (i.e., toward unadjusted profile 201) when the pressure within cylinder 135 is lower than a desired pressure.

It is contemplated that an opening of exhaust valve 170 may also or alternatively be advanced or retarded by variable valve actuation device 202. As illustrated in FIG. 3, an opening of exhaust valve 170 may be selectively advanced or additionally opened during portions of the compression and/or power strokes. Because more air/fuel mixture may escape from cylinder 135 during the compression and/or power strokes when the opening of exhaust valve 170 is advanced, the amount of trapped mass within cylinder 135 may decrease, thereby decreasing a combustion pressure, a rise-rate, and/or shifting the angular location of peaks within cylinder 135. The opening of exhaust valve 170 may also be selectively retarded during portions of the compression and/or power strokes. Because less air/fuel mixture may escape from cylinder 135 when the opening of exhaust valve 170 is retarded, the amount of trapped mass within cylinder 135 may increase, thereby increasing a combustion pressure, a rise-rate, and/or shifting the angular location of peaks within cylinder 135.

Variable valve actuation system 110 may include a plurality of variable valve actuation devices 202 configured to adjust timings of intake valves 165 and/or exhaust valves 170. As shown in FIGS. 1 and 2, variable valve actuation device 202 may be attached to and/or enclosed by a valve housing 205 of engine 105. Each cylinder 135 may have an associated variable valve actuation device 202. Variable valve actuation device 202 may selectively adjust an opening timing, closing timing, and/or lift magnitude of intake valves 165 and/or exhaust valves 170. Variable valve actuation device 202 may be any suitable device for varying a valve timing such as, for example, a hydraulic, pneumatic, or mechanical device.

In one example, variable valve actuation device 202 may be operatively connected to rocker arm 180, intake valve 165, and/or exhaust valve 170 to selectively disconnect a movement of intake and/or exhaust valves 165, 170 from a movement of rocker arm 180. For example, variable valve actuation device 202 may be selectively operated to supply hydraulic fluid, for example, at a low or a high pressure, in a manner to resist closing of intake valve 165. That is, after valve actuation assembly 175 is no longer holding intake valve 165 and/or exhaust valve 170 open, the hydraulic fluid in variable valve actuation device 202 may hold intake valve 165 and/or exhaust valve 170 open for a desired period. Similarly, the hydraulic fluid may be used to advance a closing of intake valve 165 and/or exhaust valve 170 so that intake valve 165 and/or exhaust valve 170 closes earlier than the timing affected by valve actuation assembly 175. Alternatively, intake and/or exhaust valves 165, 170 may be moved solely by variable valve actuation device 202 without the use of cams and/or rocker arms, if desired.

Variable valve actuation device 202 may selectively advance or retard a closing of intake and/or exhaust valves 165, 170 during the different strokes of engine 105. Intake valve 165 may be closed early, for example, at a crank angle of between about 180° and about 210°. Control system 125 may also control variable valve actuation device 202 to retard a closing of intake valve 165. Intake valve 165 may be closed, for example, at a crank angle of between about 210° and about 300°. Exhaust valve 170 may be varied to open at a crank angle of between about 510° and about 570° and may be varied to close at a crank angle of between about 700° and about 60°. Exhaust valve 170 may also be opened at a crank angle of about 330° and closed at a crank angle of about 390°. Control system 125 may control each variable valve actuation device 202 to vary the valve timing of each cylinder 135 independently of the valve timing of the other cylinders 135. Control system 125 may thereby independently control a throttling of each cylinder 135 solely by varying a timing of intake valves 165 and/or exhaust valves 170.

Referring back to FIG. 2, intake system 115 may direct air and/or fuel into combustion chambers 160, and may include a single fuel injector 210, a compressor 215, and an intake manifold 220. Compressor 215 may compress and deliver an air/fuel mixture from fuel injector 210 to intake manifold 220.

Compressor 215 may draw ambient air into intake system 115 via a conduit 225, compress the air, and deliver the compressed air to intake manifold 220 via a conduit 230. This delivery of compressed air may help to overcome a natural limitation of combustion engines by eliminating an area of low pressure within cylinders 135 created by a downward stroke of pistons 140. Therefore, compressor 215 may increase the volumetric efficiency within cylinders 135, allowing more air/fuel mixture to be burned, resulting in a larger power output from engine 105. It is contemplated that a cooler for further increasing the density of the air/fuel mixture may be associated with compressor 215, if desired.

Fuel injector 210 may inject fuel at a low pressure into conduit 225, upstream of compressor 215, to form an air/fuel mixture. Fuel injector 210 may be selectively controlled by control system 125 to inject an amount of fuel into intake system 115 to substantially achieve a desired air-to-fuel ratio of the air/fuel mixture. Variable valve actuation device 202 may vary a timing of intake valves 165 and/or exhaust valves 170 to control an amount of air/fuel mixture that is delivered to cylinders 135.

Exhaust system 120 may direct exhaust gases from engine 105 to the atmosphere. Exhaust system 120 may include a turbine 235 connected to exhaust passages 163 of cylinder head 155 via a conduit 245. Exhaust gas flowing through turbine 235 may cause turbine 235 to rotate. Turbine 235 may then transfer this mechanical energy to drive compressor 215, where compressor 215 and turbine 235 form a turbocharger 250. In one embodiment, turbine 235 may include a variable geometry arrangement 255 such as, for example, variable position vanes or a movable nozzle ring. Variable geometry arrangement 255 may be adjusted to affect the pressure of air/fuel mixture delivered by compressor 215 to intake manifold 220. Turbine 235 may be connected to an exhaust outlet via a conduit 260. It is also contemplated that turbocharger 250 may be replaced by any other suitable forced induction system known in the art such as, for example, a supercharger, if desired.

Control system 125 may include a controller 270 configured to control the function of the various components of engine system 100 in response to input from one or more sensors 272. Sensors 272 may be configured to monitor an engine parameter indicative of a pressure within cylinders 135 (i.e., robustness, pressure, and/or temperature of a combustion event). Each sensor 272 may be disposed within an associated cylinder 135 (i.e., in fluid contact with a respective one of combustion chambers 160), and may be electrically connected to controller 270. Sensor 272 may be any suitable sensing device for sensing an in-cylinder pressure such as, for example, a piezoelectric crystal sensor or a piezoresistive pressure sensor. Sensors 272 may measure a pressure within cylinders 135 during, for example, the compression stroke and/or the power stroke, and may generate a corresponding signal. Sensors 272 may transfer signals that are indicative of the pressures within cylinders 135 to controller 270.

Based on the signals, controller 270 may determine a combustion profile for each cylinder 135. The combustion profile may be a measurement of how the combustion pressure within cylinder 135 changes during a combustion cycle and from cycle to cycle. The combustion profile may be a continuous indication of combustion pressure within each cylinder 135. Controller 270 may monitor the signals over time to determine a pressure rise-rate within cylinder 135, a number of pressure peaks during a single cycle, a magnitude of the peaks, and/or an angular location of the peaks. Controller 270 may then relate this information to the amount of the air/fuel mixture in cylinder 135 at any given time. to thereby determine a combustion pressure profile of cylinder 135.

Controller 270 may then compare the pressure profiles of each cylinder 135 to a desired profile. In one example, the desired profile may be a profile that is predetermined such that balancing between cylinders 135 may be achieved. That is, the profile of one cylinder 135 may be compared with the profile of other cylinders 135 of engine 105. In another example, the desired profile may be a fixed base profile that may correspond to a given engine rating. In one embodiment, the desired profiles may be stored within a map of controller 270. Based on a comparison of the monitored profile with the desired profile, controller 270 may make adjustments to the timings of valves 165, 170. It is also contemplated that controller 270 may adjust an operation of engine 105 based on a predetermined engine map that is included in controller 270.

For example, controller 270 may compare the pressure rise-rate of one cylinder 135 to profiles 201 and 204. If the monitored pressure rise-rate substantially matches that of profile 201, then controller 270 may determine that cylinder 135 has a desired combustion profile. Based on the combustion profile determination, controller 270 may make an appropriate adjustment to engine 105. Specifically, controller 270 may control variable valve actuation device 202 to selectively advance and/or retard intake valves 165 of cylinders 135 to move the pressure profile within cylinders 135 toward desired profile 203.

Controller 270 may be any type of programmable logic controller known in the art for automating machine processes, such as a switch, a process logic controller, or a digital circuit. Controller 270 may serve to control the various components of engine system 100. Controller 270 may be electrically connected to the plurality of variable valve actuation devices 202 via a plurality of electrical lines 275. Controller 270 may also be electrically connected to the plurality of sensors 272 via a plurality of electrical lines 280. Controller 270 may be electrically connected to variable geometry arrangement 255 via an electrical line 285. It is also contemplated that controller 270 may be electrically connected to additional components and sensors of engine system 100 such as, for example, an actuator of fuel injector 210, if desired.

Controller 270 may include input arrangements that allow it to monitor signals from the various components of engine system 100 such as sensors 272. Controller 270 may rely upon digital or analog processing of input received from components of engine system 100 such as, for example, sensors 272 and an operator interface. Controller 270 may utilize the input to create output for controlling engine system 100. Controller 270 may include output arrangements that allow it to send output commands to the various components of engine system 100 such as variable valve actuation devices 202, variable geometry arrangement 255, fuel injector 210, and/or an operator interface.

Controller 270 may have stored in memory one or more engine maps and/or algorithms. Controller 270 may include one or more maps stored within an internal memory, and may reference these maps to determine a required change in engine operation, a modification of an engine parameter required to affect the required change in engine operation, and/or a capacity of engine 105 for the modification. Each of these maps may include a collection of data in the form of tables, graphs, and/or equations.

Controller 270 may have stored in memory algorithms associated with determining required changes in engine operation based on engine parameters such as, for example, combustion pressure. For example, controller 270 may include an algorithm that performs a statistical analysis of the combustion pressures within the plurality of cylinders 135 from combustion cycle to combustion cycle. Based on input received from sensors 272, the algorithm determines an average cylinder pressure per combustion cycle. The algorithm may then determine the statistical deviation of the combustion pressure of each cylinder 135 from the average combustion pressure. Using the statistical deviation, the algorithm may identify which cylinder pressures are required to be increased or decreased to reduce the variation in pressure. The algorithm may perform a similar statistical analysis of pressure variation between combustion cycles (i.e., as a function of time), to identify which cylinders 135 have combustion pressures that should be increased or decreased in subsequent combustion cycles.

INDUSTRIAL APPLICABILITY

The disclosed engine control system may be used in any machine having a combustion engine where consistent operation thereof is a requirement. For example, the engine control system may be particularly applicable to gaseous-fuel driven engines utilized in electrical power generation applications, where characteristics of the produced electrical power are dependent on consistent engine operation. Operation of genset 10 will now be described.

During normal combustion events, pistons 140 may move through the four strokes of the combustion cycle. The movement of pistons 140 drives the actuation of intake valves 165 and exhaust valves 170 via valve actuation assembly 175. Profile 203, shown in the lower portion of FIG. 3, may occur during normal combustion within cylinder 135.

Combustion events that are of lower magnitude and/or pressure rise-rate than desired may occur within cylinders 135 (i.e., profile 206). Profile 206 may be identified to controller 270 via pressures measured by sensors 272. Controller 270 may compare the measured pressure profile 206 within cylinder 135 to the desired combustion profile 203 to determine a pressure difference. When this type of combustion is detected within cylinder 135, the closing of intake valve 165 may be retarded within the family of curves 207 or advanced within the family of curves 209 to increase the magnitude and pressure rise-rate within cylinder 135 toward desired profile 203 (i.e., adjusted toward profile 201 of intake valve 165 that has a timing that has not been varied). Controller 270 may thereby adjust the combustion profile within cylinder 135 from profile 206 to profile 203. Sensors 272 continue to measure the pressure within cylinder 135 and provide the measured pressure to controller 270.

Combustion events that are of higher magnitude and/or pressure rise-rate than desired may occur within cylinders 135 (i.e., profile 204). Profile 204 may be identified to controller 270 via pressures measured by sensor 272. Controller 270 may compare the measured pressure profile 204 within cylinder 135 to the desired combustion profile 203 to determine a pressure difference. When this type of combustion is detected within cylinder 135, the closing of intake valve 165 may be advanced within the family of curves 207 or retarded within the family of curves 209 to decrease the magnitude and pressure rise-rate within cylinder 135 toward desired profile 203 (i.e., adjusted away from profile 201 of intake valve 165 that has a timing that has not been varied). Controller 270 may thereby adjust the combustion profile within cylinder 135 from profile 204 to profile 203. Sensors 272 continue to measure the pressure within cylinder 135 and provide the measured pressure to controller 270.

By independently adjusting the valve timing of each cylinder 135, engine system 100 may balance a loading between cylinders 135 of engine 105. The combustion profiles within each cylinder 135 may be adjusted toward a desired profile, providing a substantially balanced and constant output from engine 105 that may be beneficial for some power generation applications. Additionally, engine 105 may be operated closer to its load limit because less margin of error is required to protect the engine components from significantly higher cylinder pressures caused by pressure variations. Engine 105 may thereby be operated closer to its load limit, at an increased rating.

It will be apparent to those skilled in the art that various modifications and variations can be made to the disclosed method and apparatus. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A control system for an engine having a first cylinder and a second cylinder, the control system comprising:

a first engine valve movable to regulate a fluid flow of the first cylinder;

a first actuator associated with the first engine valve;

a second engine valve movable to regulate a fluid flow of the second cylinder;

a first sensor configured to generate a first signal indicative of a first pressure within the first cylinder;

a second sensor configured to generate a second signal indicative of a second pressure within the second cylinder; and a controller in communication with the first actuator, the first sensor, and the second sensor, the controller being configured to:

compare the first pressure with the second pressure; and selectively regulate the first actuator to adjust a timing of the first engine valve independently of the timing of the second engine valve based on the comparison.

2. The control system of claim 1, wherein the controller is configured to regulate the first actuator to adjust the timing of the first engine valve when the comparison reveals the first pressure is substantially different than the second pressure, wherein adjustment to the timing of the first engine valve results in adjustment of the first pressure within the first cylinder.

3. The control system of claim 2, wherein the controller is configured to:

adjust a valve closing toward an unadjusted profile when the first pressure is substantially lower than the second pressure; and adjust a valve closing away from the unadjusted profile when the first pressure is substantially higher than the second pressure.

4. The control system of claim 1, wherein the first signal is indicative of a peak cylinder pressure during a power stroke of the engine.

5. The control system of claim 4, wherein the adjustment to the timing of the first engine valve occurs during a stroke of a subsequent engine cycle.

6. The control system of claim 5, wherein both the first and second engine valves are intake valves.

7. The control system of claim 5, wherein the adjustment to the timing of the first engine valve occurs during an intake stroke.

8. The control system of claim 1, wherein the adjustment to the timing of the first engine valve occurs during a stroke of the same engine cycle during which the first signal is generated.

9. The control system of claim 8, wherein the first signal is indicative of a cylinder pressure during a compression stroke of the engine.

10. The control system of claim 9, wherein the adjustment to the timing of the first engine valve occurs during the compression stroke.

11. The control system of claim 10, wherein both the first and second engine valves are exhaust valves.

12. The control system of claim 10, wherein both the first and second engine valves are intake valves.

13. A method of operating an engine, comprising:

sensing a parameter indicative of a first pressure within a cylinder of the engine;

sensing a second parameter indicative of a second pressure within a second cylinder of the engine;

comparing the first pressure to the second pressure; and adjusting a valve timing associated with the cylinder independently of valve timings associated with another cylinder of the engine based on the comparison.

14. The method of claim 13, wherein adjusting the valve timing includes adjusting the valve timing when the comparison reveals the first pressure is substantially different than the second pressure.

15. The method of claim 14, wherein:

adjusting the valve timing includes:

adjusting a valve closing toward an unadjusted profile when the first pressure is substantially lower than the second pressure; and adjusting a valve closing away from the unadjusted profile when the first pressure is substantially higher than the second pressure; and adjusting the valve timing results in adjustment of the first pressure.

16. The method of claim 13, wherein:

the first pressure is a peak cylinder pressure during a power stroke of the engine; and adjusting the valve timing includes adjusting the valve timing during an intake stroke of a subsequent engine cycle.

17. The method of claim 13, wherein:

sensing the first parameter includes sensing the first parameter during a compression stroke of the engine; and adjusting the valve timing includes adjusting the valve timing during the compression stroke of the same engine cycle during which the first parameter is sensed.

* * * * *